US011806993B2

(12) United States Patent
Matsunaga

(10) Patent No.: US 11,806,993 B2
(45) Date of Patent: Nov. 7, 2023

(54) PRINTING DEVICE

(71) Applicant: SEIKO EPSON CORPORATION, Tokyo (JP)

(72) Inventor: Hideki Matsunaga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 17/448,375

(22) Filed: Sep. 22, 2021

(65) Prior Publication Data

US 2022/0097421 A1 Mar. 31, 2022

(30) Foreign Application Priority Data

Sep. 25, 2020 (JP) ..... 2020-160631

(51) Int. Cl.

| | |
|---|---|
| ***B41J 15/00*** | (2006.01) |
| ***B41J 11/00*** | (2006.01) |
| ***B65H 26/08*** | (2006.01) |
| ***B41J 11/42*** | (2006.01) |
| ***B41J 11/70*** | (2006.01) |
| ***B41J 15/04*** | (2006.01) |

(52) U.S. Cl.

CPC ..... *B41J 11/42* (2013.01); *B41J 11/0025* (2013.01); *B41J 11/0075* (2013.01); *B41J 11/0095* (2013.01); *B41J 11/70* (2013.01); *B41J 15/00* (2013.01); *B41J 15/042* (2013.01); *B65H 26/08* (2013.01)

(58) Field of Classification Search

CPC ..... B41J 11/42; B41J 11/70; B41J 11/0025; B41J 11/0075; B41J 11/666; B41J 15/042; B41J 11/0095; B41J 2/32; B41J 15/00; B65H 2301/41387; B65H 2404/71; B65H 2404/724; B65H 2511/14; B65H 2801/12; B65H 26/08

See application file for complete search history.

(56) References Cited

U.S. PATENT DOCUMENTS

| | | | | |
|---|---|---|---|---|
| 8,783,984 | B2 | 7/2014 | Kim et al. | |
| 2004/0234316 | A1* | 11/2004 | Matsuse | B41J 15/042 400/613 |

(Continued)

FOREIGN PATENT DOCUMENTS

| | | |
|---|---|---|
| CN | 101837689 | 9/2010 |
| CN | 107199786 | 1/2020 |
| JP | 2012-184056 A | 9/2012 |

*Primary Examiner* — Yaovi M Ameh

(74) *Attorney, Agent, or Firm* — WORKMAN NYDEGGER

(57) ABSTRACT

A printing device includes a roll paper holder configured to accommodate a first roll paper and a second roll paper and having first and second side walls configured to contact side surfaces of the first roll paper, a remaining amount detecting section having a first projection projecting from the first side wall to detect a remaining amount of the first roll paper accommodated in the roll paper holder, a roll paper guide configured to be installed in the roll paper holder and having a third side wall configured to contact a side surface of the second roll paper when the second roll paper is accommodated in the roll paper holder, and a detection assistance section provided on the roll paper guide and having a second projection projecting from the third side wall in a state of being in contact with the first projection.

7 Claims, 11 Drawing Sheets

(56) References Cited

U.S. PATENT DOCUMENTS

| | | | | |
|---|---|---|---|---|
| 2010/0239347 | A1* | 9/2010 | Kim | B41J 3/4075 400/621 |
| 2012/0224905 | A1 | 9/2012 | Nihashi | |
| 2012/0280101 | A1* | 11/2012 | Bouverie | F16B 2/12 248/316.4 |
| 2014/0023420 | A1 | 1/2014 | Fujita et al. | |
| 2015/0053810 | A1* | 2/2015 | Chang | B65H 26/08 242/563 |

* cited by examiner

PRINTING DEVICE

The present application is based on, and claims priority from JP Application Serial Number 2020-160631, filed Sep. 25, 2020, the disclosure of which is hereby incorporated by reference herein in its entirety.

BACKGROUND

1. Technical Field

The present disclosure relates to a printing device.

2. Related Art

Printing devices in the related art are known that include a remaining amount detecting section for detecting a remaining amount of roll paper (see, for example, JP-A-2012-184056).

The remaining amount detecting section includes an arm that is provided on the outer surface side of a side plate of a hopper that holds the roll paper, is swingable toward the side plate, and is urged by a spring, and a protrusion formed at an end of the arm to penetrate the side plate. When the outer diameter of the roll paper is large, the protrusion is in contact with the side surface of the roll paper; in contrast, when the outer diameter of the roll paper is small, the protrusion enters the hollow portion of the winding core of the roll paper, causing the arm to swing. As a result, the swing of the arm is detected by the sensor, and a low remaining amount of the roll paper is detected.

In JP-A-2012-184056, the printing device does not have a structure for accommodating a roll paper having a narrow paper width, but when a roll paper having a narrow paper width is accommodated in this type of printing device, it is conceivable to install a partition portion in a roll paper accommodating portion. However, when the partition portion is installed between a remaining amount detecting section and the roll paper, the remaining amount detecting section is blocked by the partition portion, and thus the remaining amount of the roll paper cannot be detected. Therefore, a structure is desired that is capable of corresponding to a roll paper having a different paper width and detecting the remaining amount of the roll paper.

SUMMARY

According to an aspect of the present disclosure, there is provided a printing device including a roll paper holder configured to accommodate a first roll paper and a second roll paper having a width smaller than that of the first roll paper and configured to have a first side wall and a second side wall configured to contact side surfaces of the first roll paper, a remaining amount detecting section configured to have a first projection projecting from the first side wall to detect a remaining amount of the first roll paper accommodated in the roll paper holder, a partition portion configured to be installed in the roll paper holder and configured to have a third side wall configured to contact a side surface of the second roll paper when the second roll paper is accommodated in the roll paper holder, and a detection assistance section configured to be provided in the partition portion and configured to have a second projection projecting from the third side wall in a state of being in contact with the first projection.

According to another aspect of the present disclosure, there is provided a printing device including a roll paper holder configured to accommodate a first roll paper and a second roll paper having a width smaller than that of the first roll paper and configured to have a first side wall and a second side wall configured to contact side surfaces of the first roll paper, a remaining amount detecting section configured to detect a remaining amount of the first roll paper accommodated in the roll paper holder, a partition portion configured to be installed in the roll paper holder and configured to have a third side wall configured to contact a side surface of the second roll paper when the second roll paper is accommodated in the roll paper holder, and a detection assistance section configured to be provided in the partition portion and configured to assist the remaining amount detecting section in detecting a remaining amount of the second roll paper.

DESCRIPTION OF EXEMPLARY EMBODIMENTS

Hereinafter, embodiments to which the present disclosure are applied will be described with reference to the drawings. In each figure, for convenience of understanding, each member is illustrated on a scale different from the actual one.

Figure 1:
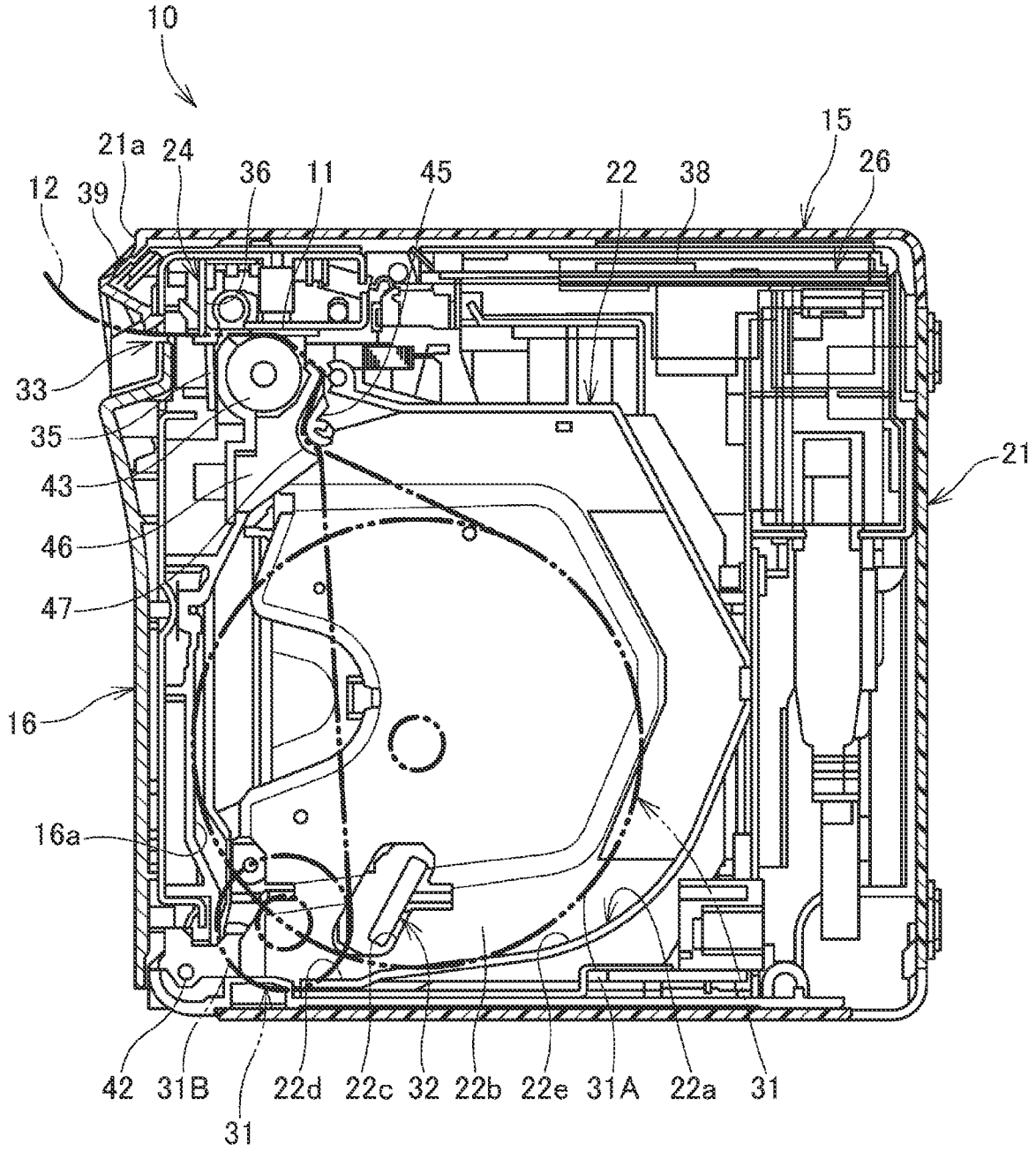
FIG. 1 is a side sectional view of a printing device according to an embodiment of the present disclosure when viewed from the side.
Figure 2:
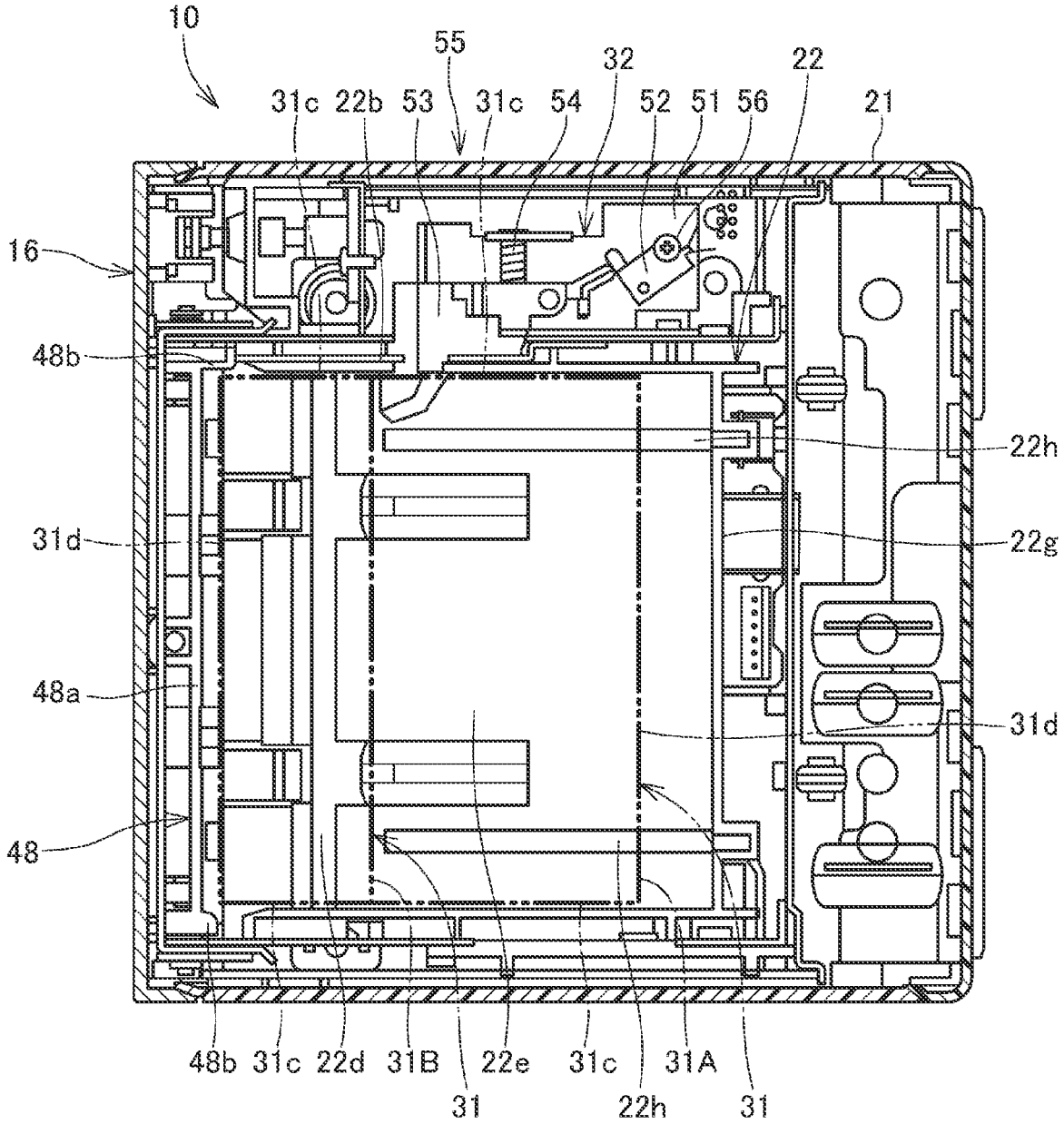
FIG. 2 is a top sectional view of the printing device when viewed from above.

FIG. 1 is a side sectional view of a printing device 10 according to an embodiment of the present disclosure when viewed from the side, and FIG. 2 is a top sectional view of the printing device 10 when viewed from above.

As shown in FIG. 1, a printing device 10 records information such as characters and images on a recording surface of a thermal paper 12, which is a recording medium, by a thermal head 11 in which a plurality of heat generating resistors are arranged in a line. The thermal paper 12 corresponds to an example of a recording paper.

The printing device 10 has a box shape and includes a main body 15 and an opening/closing cover 16 provided on the front portion of the main body 15 to be open/closed.

The main body 15 accommodates a roll paper holder 22, the thermal head 11, a part of a cutter unit 24, and a substrate 26 in a resin case 21. The cutter unit 24 corresponds to an example of a cutting mechanism.

The case 21 forms a cover that covers an upper portion of the front surface, both side surfaces, the upper surface, the lower surface, and the back surface of the main body 15.

The roll paper holder 22 accommodates the roll paper in which the thermal paper 12 is rolled into a roll shape. The printing device 10 can use the thermal paper 12 having a different paper width as a recording medium. In the present embodiment, an example in which a first roll paper 31 having a predetermined width and a second roll paper 61 having a paper width narrower than that of the first roll paper are used will be described. When the second roll paper 61 is used in the printing device 10, roll paper guides 65 and 66, which will be described later, are mounted on the roll paper holder 22 corresponding to the narrow paper width. FIG. 2 shows the printing device 10 in a state in which the roll paper guides 65 and 66, which will be described later, are not mounted, which is in a state in which the first roll paper 31 can be accommodated.

The roll paper holder 22 includes a placement portion 22*a* on which the first roll paper 31 is placed, and an opening 22*c* opened in a side wall 22*b* on one left side when the printing device 10 is viewed from the front. The side wall 22*b* corresponds to an example of a first side wall.

The placement portion 22*a* includes a bottom 22*d* formed to be the lowest and flat in the placement portion 22*a* at a front end thereof, and a slope 22*e* curved so as to gradually increase from the rear end of the bottom 22*d* toward the rear. Assuming that the first roll paper 31 having a large outer diameter at the beginning of use is a first roll paper 31A, the first roll paper 31A is placed on the slope 22*e* and is held in a state of being in contact with the inner surface 16*a* of the opening/closing cover 16 in the roll paper holder 22.

Assuming that the first roll paper 31 of which outer diameter has been decreased up to less than a predetermined value due to the consumption of the thermal paper 12 is a first roll paper 31B, the first roll paper 31B is located at the bottom 22*d*.

In the figure, the contours and winding cores of the first roll papers 31A and 31B and the thermal paper 12 drawn from the first roll papers 31A and 31B are shown by double-dashed lines.

The printing device 10 of the present embodiment includes a remaining amount detecting section 32 for detecting the first roll paper 31B in order to prompt replacement of the first roll paper 31B of which an outer diameter has been decreased up to less than the predetermined value. A part of the remaining amount detecting section 32 is exposed to the first roll paper 31 from the opening 22*c* of the roll paper holder 22.

The thermal head 11 is disposed above a platen 43 provided on the opening/closing cover 16 to face the platen 43. The thermal paper 12 drawn from the first roll paper 31 is interposed between the thermal head 11 and the platen 43, and the thermal paper 12 is transported forward by the rotational drive of the platen 43 and characters and images are recorded on the thermal paper 12 by the thermal head 11.

The cutter unit 24 has a fixed blade 35 and a movable blade 36 arranged close to a paper outlet 33 of the thermal paper 12 with respect to the thermal head 11 and the platen 43 and a cutter drive motor (not shown) for driving the movable blade 36. The fixed blade 35 is arranged on the opening/closing cover 16, and the movable blade 36 is arranged on the main body 15. The movable blade 36 descends and cooperates with the fixed blade 35 to sandwich the thermal paper 12, and cuts a part or the whole of the thermal paper 12. When a partial cut for cutting a part of the thermal paper 12 is performed, the central portion of the paper width of the thermal paper 12 is not cut, and thus the user tears off the uncut portion of the thermal paper 12 to cut it.

The fixed blade 35 corresponds to an example of a second blade, and the movable blade 36 corresponds to an example of a first blade.

The substrate 26 is disposed at the rear portion of the upper portion of the printing device 10, and includes a controller 38 that controls each portion of the printing device 10. Further, the front surface 21*a* of the case 21 of the main body 15 is provided with a display 39 for displaying each state of the printing device 10. The display 39 is an indicator that displays the operating state and the like of the printing device 10. The display 39 displays, for example, the low remaining amount of the thermal paper 12 as will be described later according to the control of the controller 38. The controller 38 corresponds to an example of a processor.

The opening/closing cover 16 is swingably supported on the lower end of the front portion of the main body 15 via a hinge shaft 42. The opening/closing cover 16 can be temporarily fixed to the main body 15. The opening/closing cover 16 includes the platen 43 and the fixed blade 35 arranged in front of the platen 43 at the upper portion.

The platen 43 is rotatably supported by the opening/closing cover 16. The platen 43 not only functions as a base for supporting the thermal paper 12 during recording, but also serves as a transport mechanism for the thermal paper 12.

Next, a transport path of the thermal paper 12 will be described below.

The main body 15 includes a first paper guide portion 45 above the roll paper holder 22. Further, the opening/closing cover 16 includes a second paper guide portion 46 below the platen 43, and the second paper guide portion 46 is disposed in front of the first paper guide portion 45. The first paper guide portion 45 and the second paper guide portion 46 are disposed at a predetermined distance in a front-rear direction, and an upstream transport path 47 is provided between the first paper guide portion 45 and the second paper guide portion 46.

The thermal paper 12 drawn from the first roll paper 31A contacts the first paper guide portion 45 on the inlet side of the upstream transport path 47 and contacts the second paper guide portion 46 on the outlet side of the upstream transport path 47. Then, the thermal paper 12 passes between the platen 43 and the thermal head 11 located downstream in the upstream transport path 47, and transported in front of the printing device 10 via a paper outlet 33 between the front end of the main body 15 and the opening/closing cover 16.

Further, the thermal paper 12 drawn from the first roll paper 31B contacts the second paper guide portion 46 on the inlet side of the upstream transport path 47, and further, contacts the first paper guide portion 45 at the intermediate portion of the upstream transport path 47 and again contacts the second paper guide portion 46 on the outlet side of the upstream transport path 47. Then, a downstream portion of the upstream transport path 47 traces the same transport path as the thermal paper 12 of the first roll paper 31A.

As shown in FIG. 2, the roll paper holder 22 is formed in a rectangular shape in a plan view, and includes a pair of right and left side walls 22*f* and 22*b* and a rear wall 22*g* coupled to respective rear ends of the right and left side walls 22*f* and 22*b*. The right and left side walls 22*f* and 22*b* hold both side surfaces 31*c* of the first roll paper 31. The side wall 22*f* corresponds to an example of a second side wall.

The opening/closing cover 16 includes, in front of the roll paper holder 22, a roll paper abutting portion 48 on which the first roll paper 31 abuts. The roll paper abutting portion 48 is formed in a concave shape with the rear portion being opened, and includes a front wall 48*a* and a pair of right and left side walls 48*b*. An outer peripheral surface 31*d* of the first roll paper 31 contacts the front wall 48*a*, and both side surfaces 31*c* of the first roll paper 31 are held by the right and left side walls 48*b*.

On the side of the side wall 22*b*, the remaining amount detecting section 32 is disposed for detecting the remaining amount of the first roll paper 31, that is, the first roll paper 31 of which the diameter is less than a predetermined outer diameter.

The remaining amount detecting section 32 includes a base 51, a detection switch 52 provided on the base 51, a first detection lever 53, and a first compression coil spring 54. The first detection lever 53 corresponds to an example of a first projection main body, and the first compression coil spring 54 corresponds to an example of a first urging portion.

The base 51 is fixed to the case 21. The detection switch 52 is attached to the base 51 and turns on or off depending on the swing state of the first detection lever 53.

The first detection lever 53 is swingably supported by the base 51 via a support shaft 57, and the swing state of the first detection lever 53 is transmitted to the detection switch 52. The first compression coil spring 54 urges the first detection lever 53 to swing inward of the roll paper holder 22.

The first detection lever 53 and the first compression coil spring 54 constitute a first projection 55.

The first detection lever 53 is swingably supported by the base 51 via the support shaft 57; however, the present disclosure is not limited thereto. For example, the first detection lever 53 may be provided on the base 51 to be slidable so that the entire first detection lever 53 moves.

A detailed structure and operation of the remaining amount detecting section 32 described above will be described below.

Figure 3:
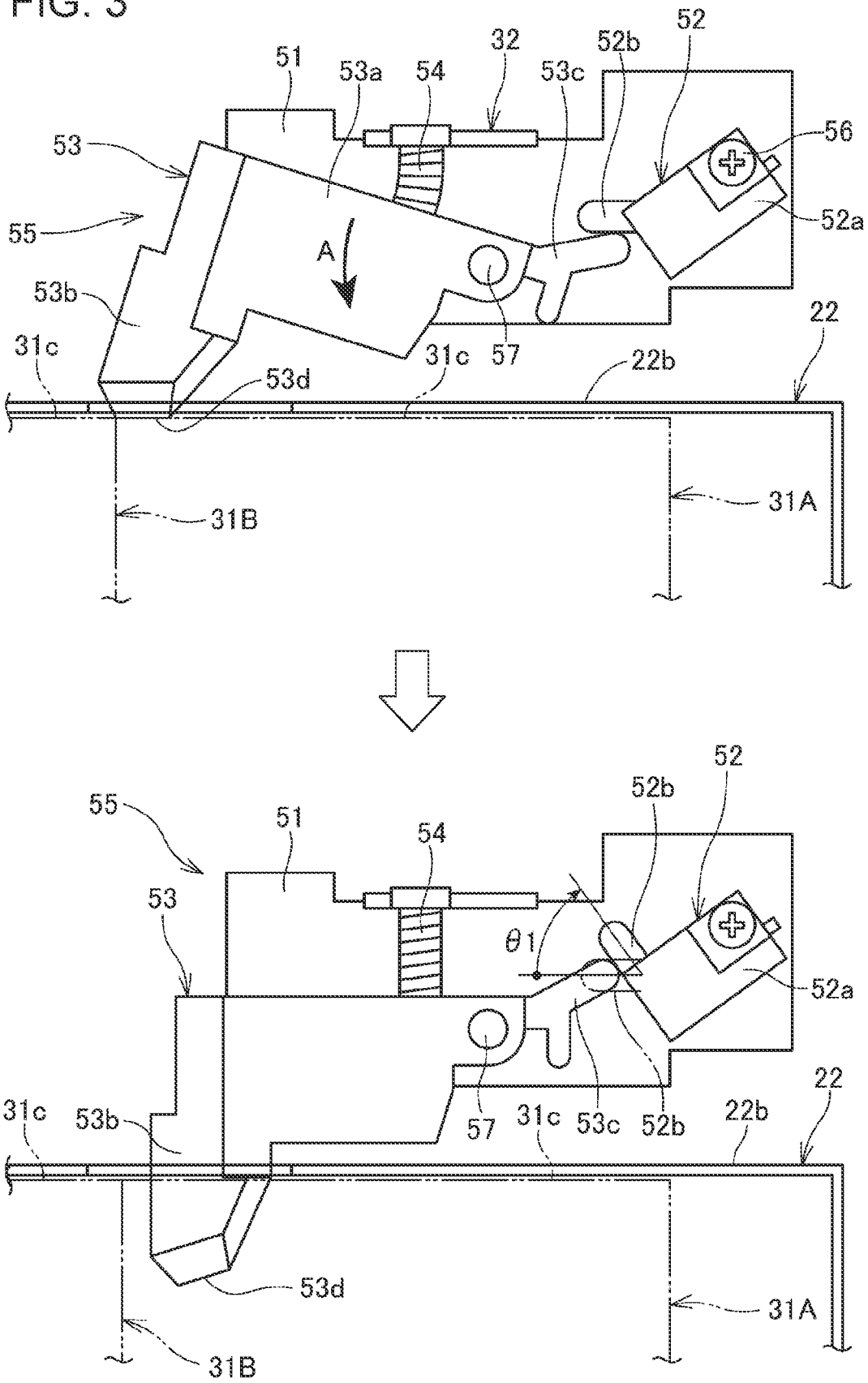
FIG. 3 is a diagram illustrating a detailed structure and operation of a remaining amount detection mechanism.

FIG. 3 is an operation diagram illustrating a detailed structure and operation of the remaining amount detecting section 32.

The detection switch 52 includes a switch main body 52*a* attached to the base 51 with screws 56, and a detector 52*b* swingably provided on the switch main body 52*a*. The detector 52*b* is swingably supported around a swing shaft (not shown) and is urged counterclockwise by an urging member (not shown). The switch main body 52*a* is turned on or off depending on the swing position of the detector 52*b*.

The first detection lever 53 includes a lever base 53*a* provided on the support shaft 57 and a first protrusion 53*b* formed at the tip end of the lever base 53*a*. The lever base 53*a* includes an arm portion 53*c* projecting toward the detection switch 52, and the arm portion 53*c* is in contact with the detector 52*b* of the detection switch 52.

The first compression coil spring 54 urges the first detection lever 53 to swing inward of the roll paper holder 22.

A tip end 53*d* of the first protrusion 53*b* of the first detection lever 53 is pressed against the side surface 31*c* of the first roll paper 31A. In this state, the arm portion 53*c* of the first detection lever 53 contacts the detector 52*b* of the detection switch 52, and thus the detector 52*b* is in a position extending in the front-rear direction. When the detector 52*b* is at this position, the detection switch 52 is in the off state.

When the thermal paper 12 of the first roll paper 31A is consumed in this state and becomes the first roll paper 31B having the outer diameter less than a predetermined value, the tip end 53*d* of the first protrusion 53*b* does not come into contact with the side surface 31*c* of the first roll paper 31B. As a result, the first detection lever 53 swings counterclockwise around the support shaft 57 by the urging force of the first compression coil spring 54, as shown by arrow A, and is shown by the white arrow, and the first protrusion 53*b* shifts to a state of projecting into the roll paper holder 22.

At this time, as the arm portion 53*c* of the first detection lever 53 swings, the detector 52*b* of the detection switch 52 swings clockwise by an angle θ1 from the state before the swing of the first detection lever 53. As a result, the detection switch 52 is turned from OFF to ON, and this on signal is input to the controller 38.

The controller 38 controls the display 39 to display the fact that the remaining amount of the first roll paper 31 is low, based on the on signal from the detection switch 25.

In this way, the position where the first protrusion 53*b* of the first detection lever 53 projects from the side wall 22*b* to the inside of the roll paper holder 22 is defined as a first position. In a state where the first detection lever 53 projects into the roll paper holder 22, the first detection lever 53 contacts a stopper (not shown) provided on the base 51 or the roll paper holder 22 while receiving the urging force from the first compression coil spring 54 and becomes stationary.

Further, the position where a projecting amount of the first protrusion 53*b* of the first detection lever 53 from the side wall 22*b* to the inside of the roll paper holder 22 is less than that at the first position or the first protrusion 53*b* does not project is defined as a second position. As described above, the first protrusion 53*b* of the first detection lever 53 can move between the first position and the second position.

Subsequently, a configuration when the second roll paper 61 is accommodated in the printing device 10 will be described.

Figure 4:
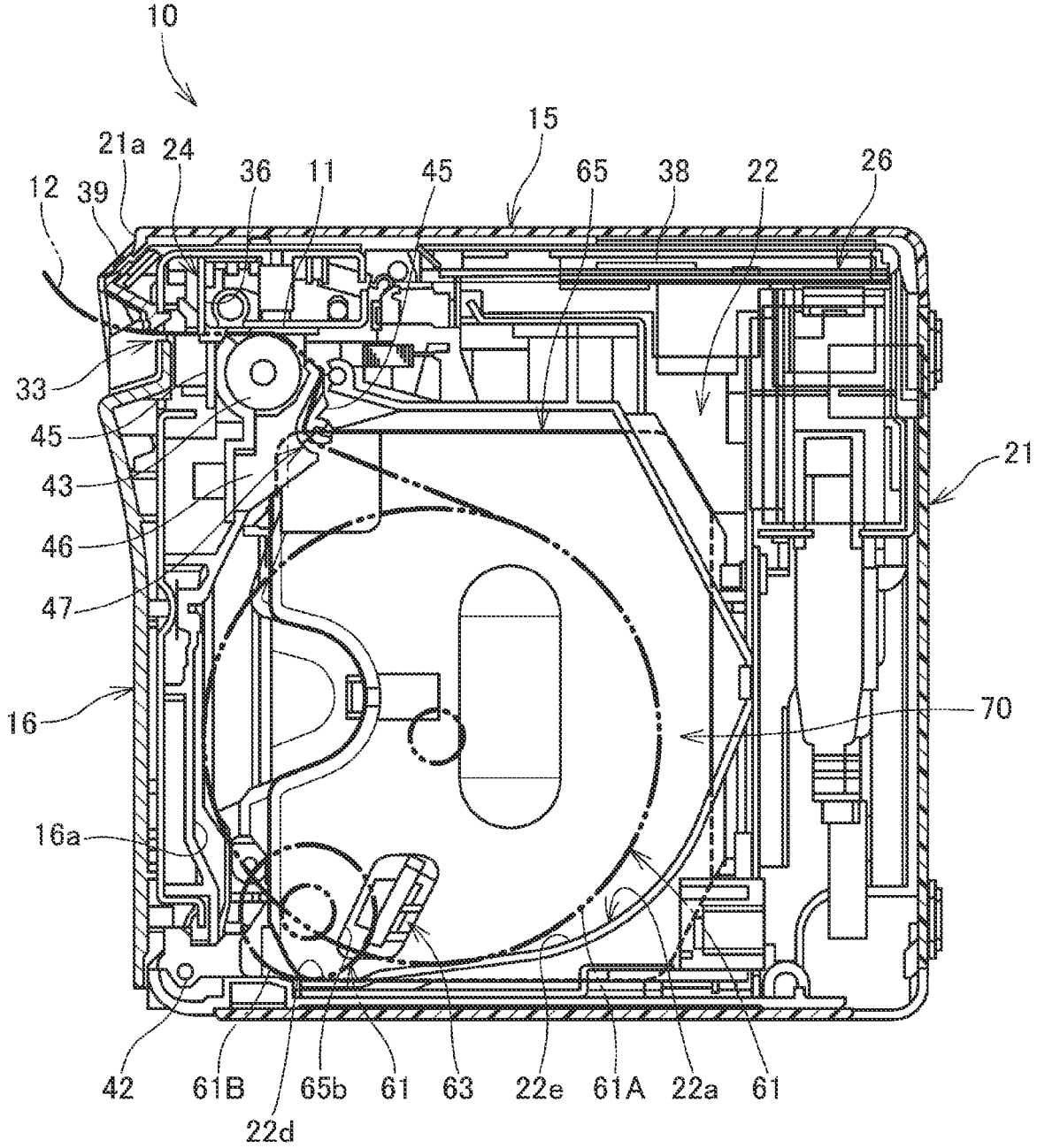
FIG. 4 is a side sectional view illustrating a state in which a roll paper guide is mounted on a roll paper holder.
Figure 5:
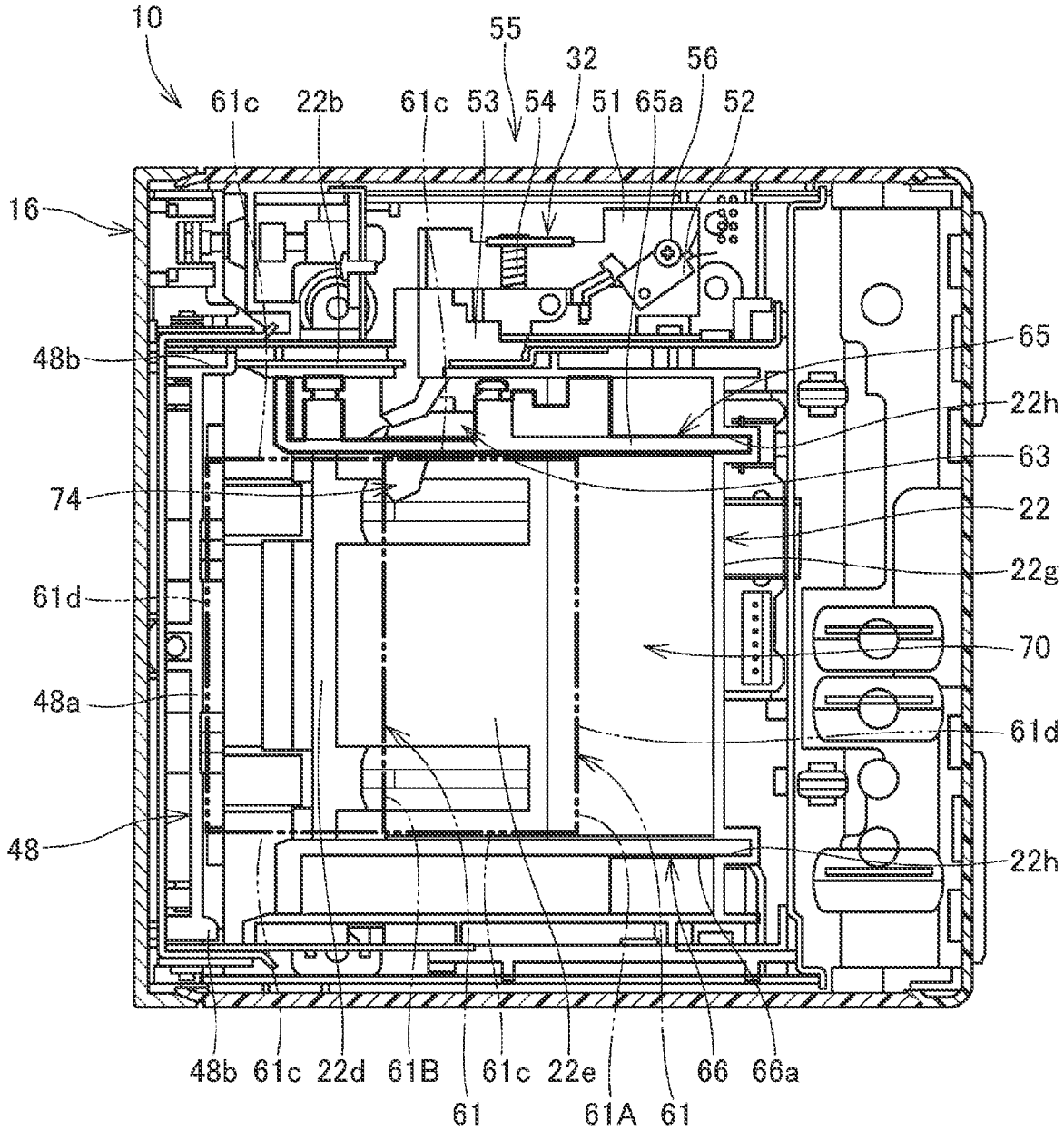
FIG. 5 is a plan sectional view illustrating a state in which roll paper guides are mounted on the roll paper holder.

FIG. 4 is a side sectional view illustrating a state in which the roll paper guide 65 is mounted on the roll paper holder 22, and FIG. 5 is a plan sectional view illustrating state in which a pair of right and left roll paper guides 66 and 65 are mounted on the roll paper holder 22.

The roll paper guides 65 and 66 are members that stabilize the second roll paper 61, which has a narrower paper width than the first roll paper 31, in the roll paper holder 22 by being mounted on the roll paper holder 22.

As shown in FIG. 4 and FIG. 5, on the roll paper holder 22, a pair of right and left guide mounting groove portions 22*h* are formed that extends in the front-rear direction in a plan view. The roll paper guides 65 and 66 for holding the second roll paper 61, which has the narrower paper width than the first roll paper 31, are mounted on the right and left guide mounting groove portions 22*h*. The roll paper guide 65 is disposed close to the side wall 22*b* of the roll paper holder 22, and the roll paper guide 66 is disposed close to the side wall 22*f* of the roll paper holder 22. By mounting the roll paper guides 65 and 66, the space for accommodating the second roll paper 61 in the roll paper holder 22 is narrowed, and the second roll paper 61 is stabilized.

The roll paper guide 65 on the left side is provided with a detection assistance section 63 for assisting the remaining amount detecting section 32 in detecting the remaining amount, and the roll paper guide 66 on the right side is not provided with the remaining amount detecting section 32.

The right and left roll paper guides 66 and 65 are provided with side walls 66*a* and 65*a* for holding the side surface 61*c* of the second roll paper 61, respectively. Further, one roll paper guide 65 is provided with an opening 65*b* in the side wall 65*a*. Through the opening 65*b*, the detection assistance section 63 is exposed to a roll paper accommodating space 70 between the right and left roll paper guides 66 and 65. The roll paper guide 65 corresponds to an example of a partition portion, a first partition section, and the roll paper guide 66 corresponds to an example of a partition portion, a second partition section. Further, the side wall 65*a* corresponds to an example of a third side wall, and the side wall 66*a* corresponds to an example of a fourth side wall.

Assuming that the second roll paper 61 having a large outer diameter at the beginning of use is a second roll paper 61A, the second roll paper 61A is placed on the slope 22*e* and is held in a state of being in contact with the inner surface 16*a* of the opening/closing cover 16 in the roll paper holder 22.

Assuming that the second roll paper 61 of which outer diameter has been decreased up to less than a predetermined value due to the consumption of the thermal paper 12 is a second roll paper 61B, the second roll paper 61B is located at the bottom 22*d*.

The printing device 10 of the present embodiment includes the detection assistance section 63 for assisting the remaining amount detecting section 32 in detecting the remaining amount in order to prompt the replacement of the second roll paper 61B.

Hereinafter, the roll paper guide 65 including the detection assistance section 63 will be described.

Figure 6:
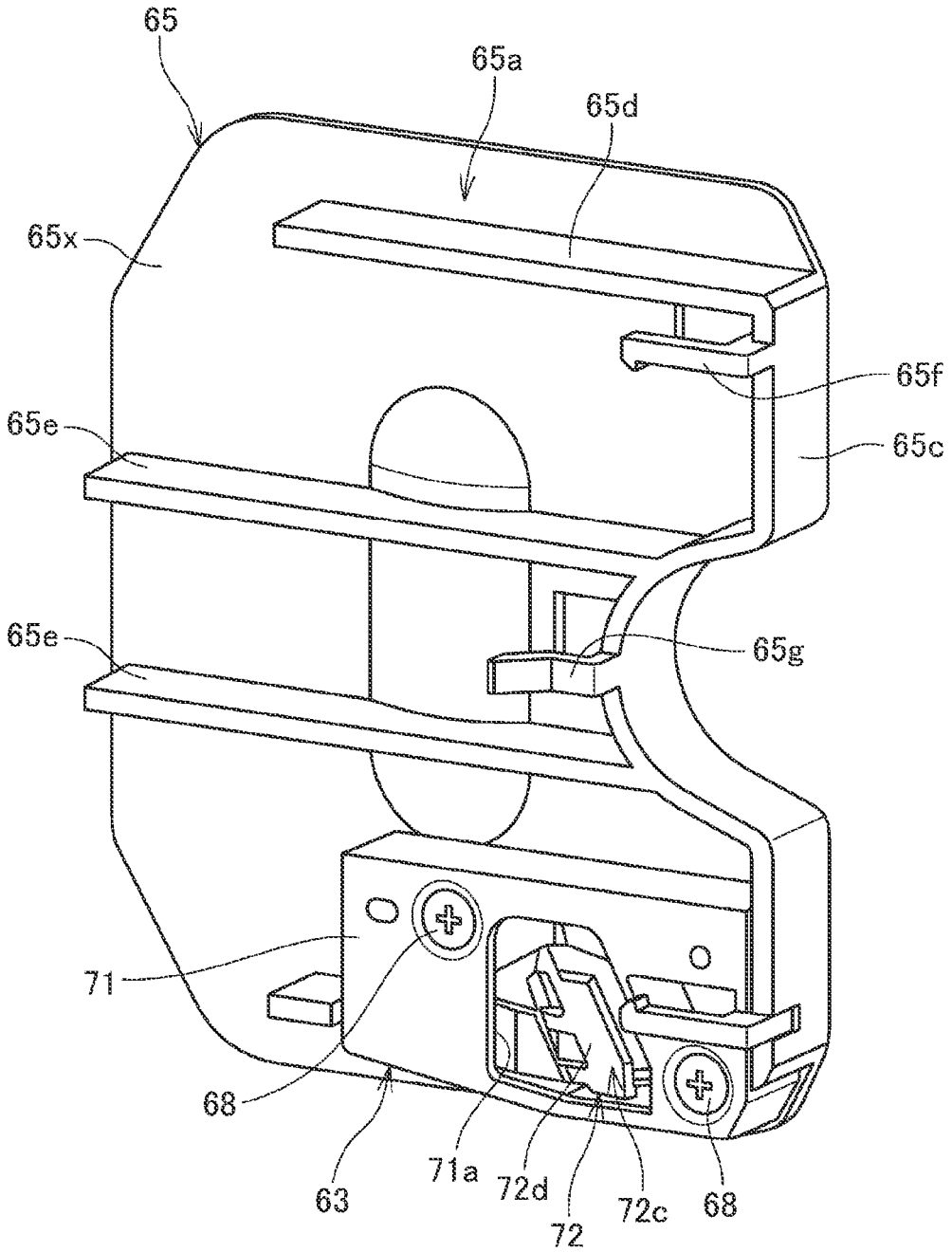
FIG. 6 is a first perspective view illustrating the roll paper guide and a detection assistance section.
Figure 7:
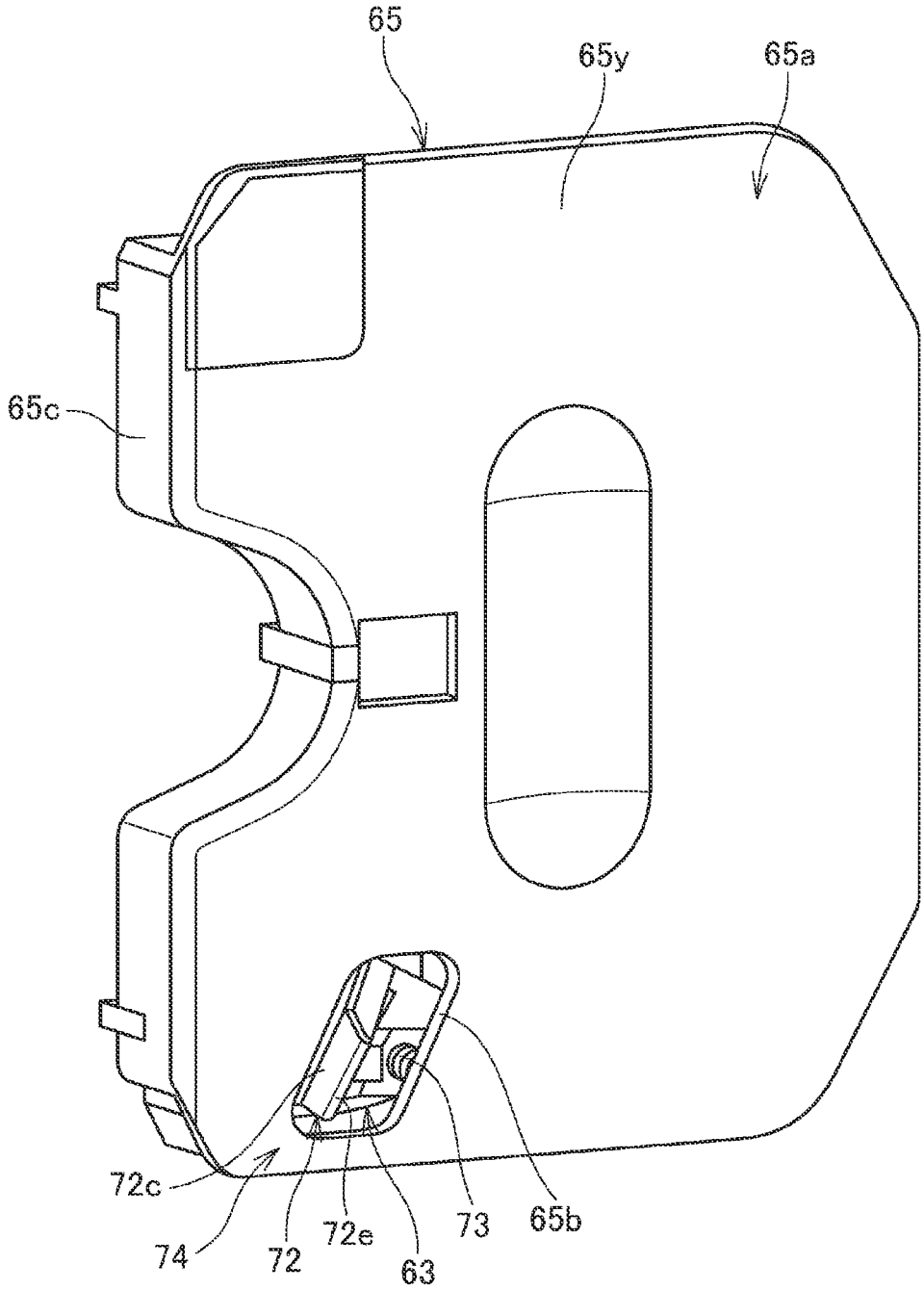
FIG. 7 is a second perspective view illustrating the roll paper guide and the detection assistance section.

FIG. 6 is a first perspective view illustrating the roll paper guide 65 and the detection assistance section 63, and FIG. 7 is a second perspective view illustrating the roll paper guide 65 and the detection assistance section 63. FIG. 6 is a perspective view when viewed from an outer surface 65*x*'s side of the side wall 65*a*, and FIG. 7 is a perspective view when viewed from the inner surface 65*y*'s side of the side wall 65*a*.

As shown in FIG. 6, the roll paper guide 65 includes the side wall 65*a*, a vertical rib 65*c* extending laterally from the front edge of the side wall 65*a*, and a plurality of lateral ribs 65*d* and 65*e* extending rearward on the side wall 65*a* from the upper portion and the intermediate portion of the vertical rib 65*c* in a vertical direction, respectively.

The vertical rib 65*c* and the plurality of lateral ribs 65*d* and 65*e* are portions for increasing the rigidity of the side wall 65*a*.

Further, the vertical rib 65*c* includes a plurality of engaging portions 65*f* and 65*g* that project rearward from the upper portion and the intermediate portion in the vertical direction, apart from the side wall 65*a*. The plurality of engaging portions 65*f* and 65*g* are portions that are engaged with the roll paper holder 22 when the roll paper guide 65 is mounted on the roll paper holder 22.

As shown in FIGS. 6 and 7, the detection assistance section 63 is constituted by a detecting section cover 71 attached to the lower portion of the side wall 65*a* with a plurality of screws 68, and a second detection lever 72 accommodated in the detecting section cover 71 and a second compression coil spring 73. The second detection lever 72 corresponds to an example of a second projection main body, and the second compression coil spring 73 corresponds to an example of a second urging portion.

The detecting section cover 71 includes a cover opening 71*a* through which the second detection lever 72 is exposed.

The second detection lever 72 is urged by the second compression coil spring 73 toward the side wall 22*b* of the roll paper holder 22 on the left. In FIG. 7, the second detection lever 72 does not project through the opening 65*b* of the side wall 65*a* due to the urging force of the second compression coil spring 73. However, when the first detection lever 53 of the remaining amount detecting section 32 projects into the roll paper holder 22, the second detection lever 72 is pushed by the first detection lever 53 to project through the opening 65*b*.

The second detection lever 72 and the second compression coil spring 73 constitute a second projection 74.

Figure 8:
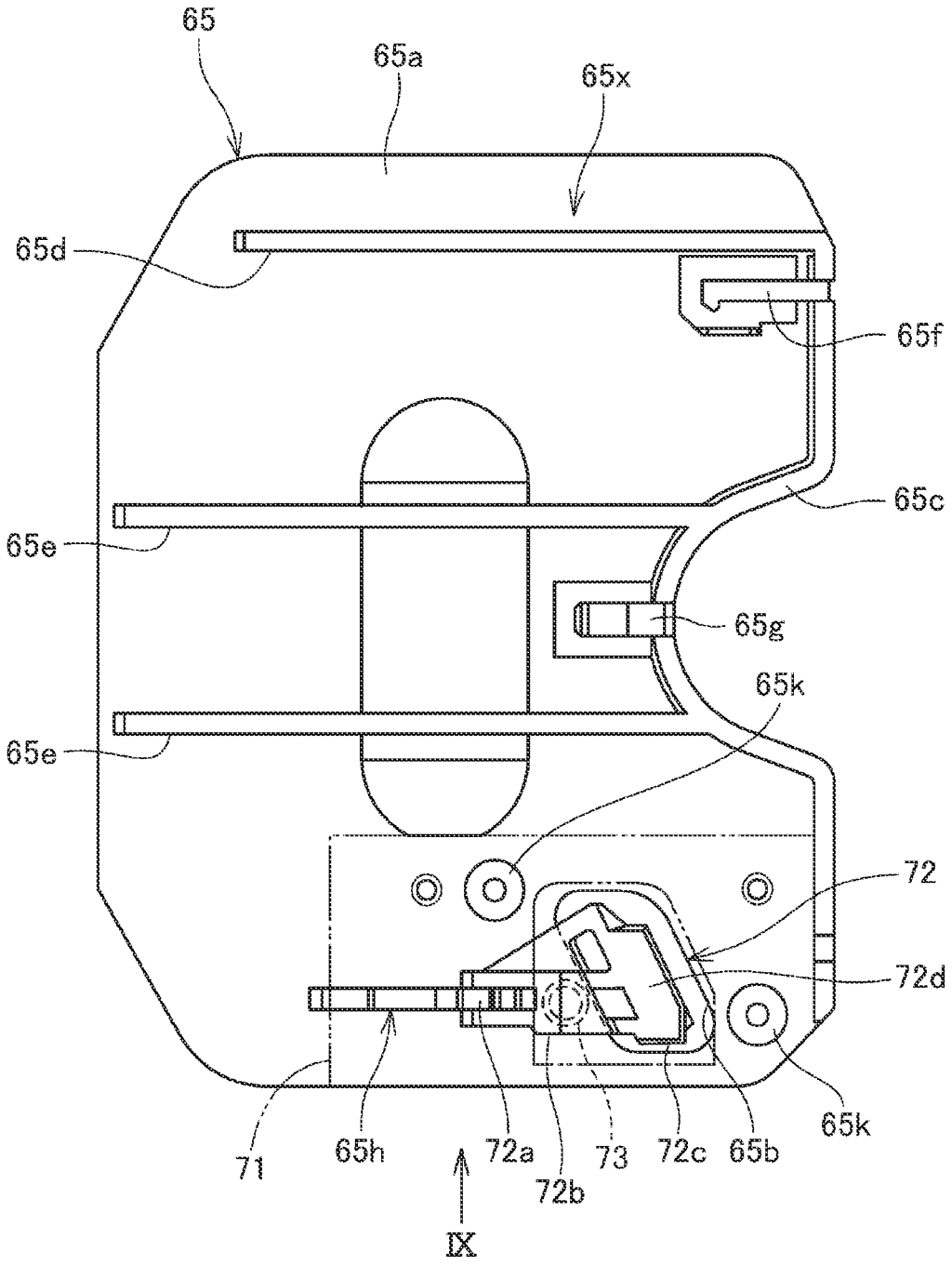
FIG. 8 is a side view illustrating a state in which a detecting section cover is removed from the state of FIG. 6.
Figure 9:
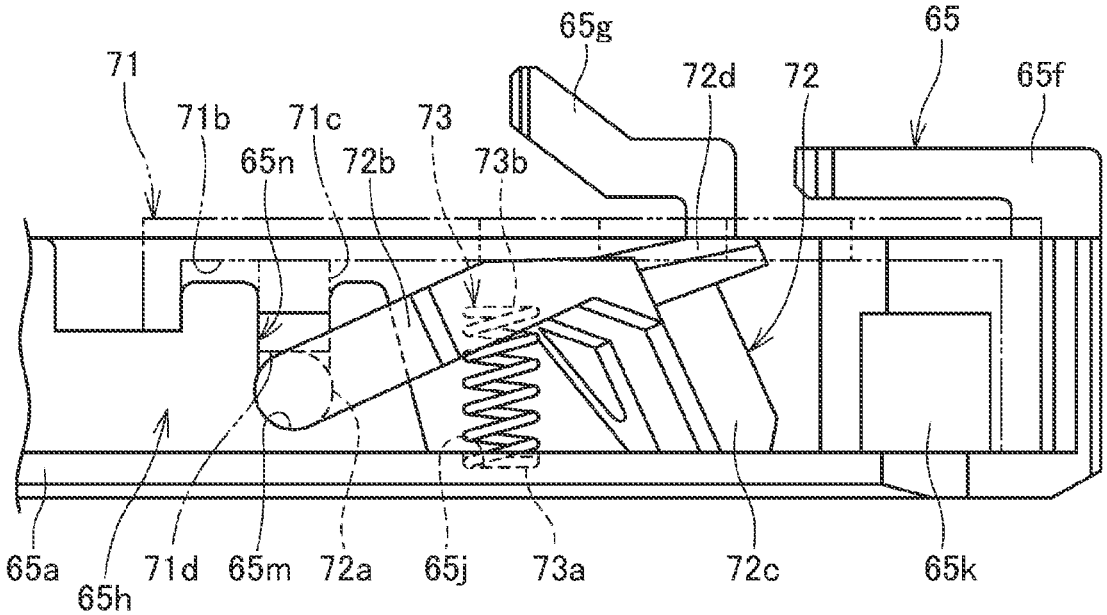
FIG. 9 is a view when seen from arrow IX of FIG. 8.
Figure 10:
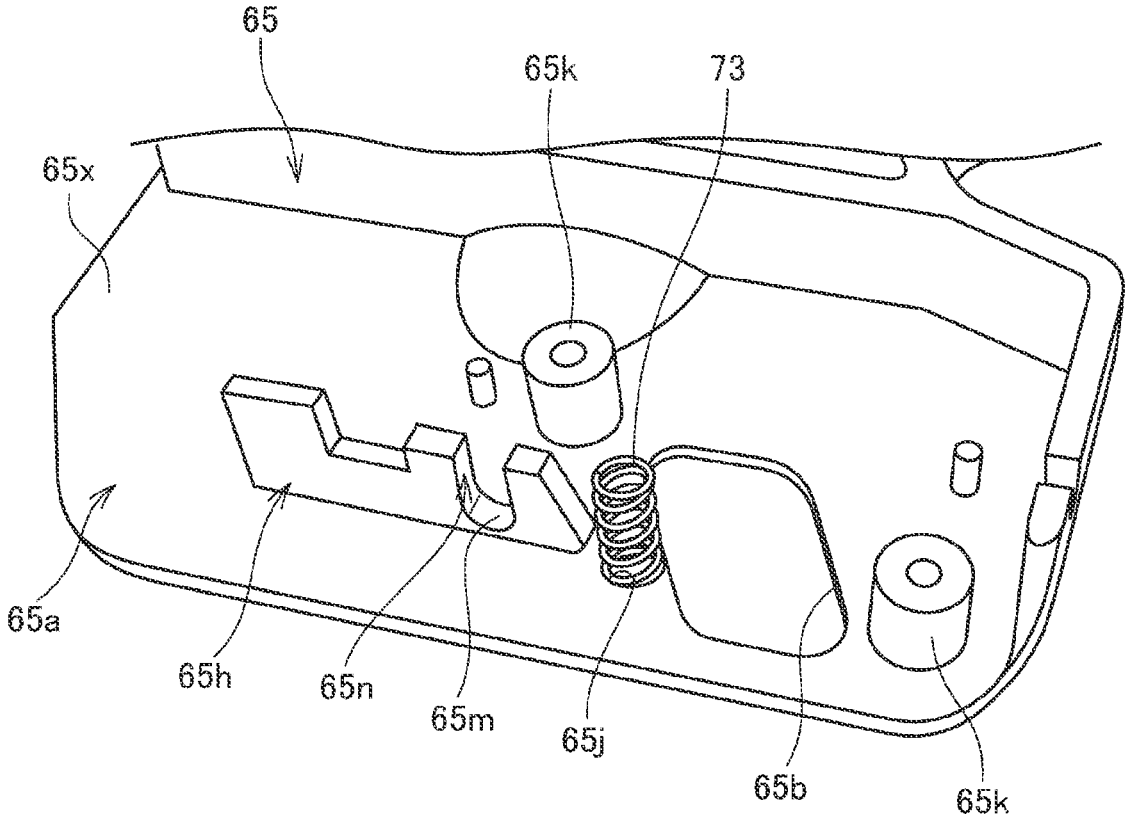
FIG. 10 is a main part perspective view illustrating a state in which a second detection lever is removed from the state of FIG. 8.

FIG. 8 is a side view illustrating a state in which the detecting section cover 71 is removed from the state of FIG. 6, FIG. 9 is a view when seen from arrow IX of FIG. 8, and FIG. 10 is a main part perspective view illustrating a state in which the second detection lever 72 is removed from the state of FIG. 8.

As shown in FIGS. 8 to 10, a horizontal wall 65*h*, a recess 65*j*, and a pair of boss portions 65*k* are formed on the lower portion of the outer surface 65*x* of the side wall 65*a* of the roll paper guide 65.

The horizontal wall 65*h* includes a notch 65*n* extending horizontally at a rear position of the opening 65*b* and having a bottom 65*m* formed in a concave arc. The recess 65*j* positions one end 73*a* of the second compression coil spring 73. The pair of boss portions 65*k* are portions where the pair of screws 68 are screwed together.

The second detection lever 72 includes a cylindrical shaft portion 72*a*, a plate-shaped portions 72*b* extending from both ends of the shaft portion 72*a*, and second protrusions 72*c* formed to bend at the tip end of the plate-shaped portion 72*b*.

The shaft portion 72*a* is inserted into the notch 65*n* of the horizontal wall 65*h*, projects from the inner surface 71*b* of the detecting section cover 71, and is held by the end surface 71*d* of a pressing portion 71*c* inserted into the notch 65*n*. As a result, the shaft portion 72*a* is prevented from coming off from the notch 65*n* and is rotatably supported by the horizontal wall 65*h* and the pressing portion 71*c*. Thereby, the second detection lever 72 is swingably supported by the horizontal wall 65*h* and the pressing portion 71*c* via the shaft portion 72*a*.

The second detection lever 72 is swingably supported via the shaft portion 72*a*; however, the present disclosure is not limited thereto. For example, the second detection lever 72 may be provided on the roll paper guide 65 to be slidable so that the entire second detection lever 72 moves.

The other end 73*b* of the second compression coil spring 73 is pressed against one side surface of the plate-shaped portion 72*b* to urge the second detection lever 72. Further, the other side surface of the plate-shaped portion 72*b* contacts the inner surface 71*b* of the detecting section cover 71, and the swing of the second detection lever 72 is restricted.

The back surface 72*d* of the second protrusion 72*c* is formed on a flat surface, and the tip end 53*d* of the first protrusion 53*b* of the remaining amount detecting section 32 is pressed against the back surface 72*d*.

Operations of the remaining amount detecting section 32 and the detection assistance section 63 described above will be described below.

Figure 11:
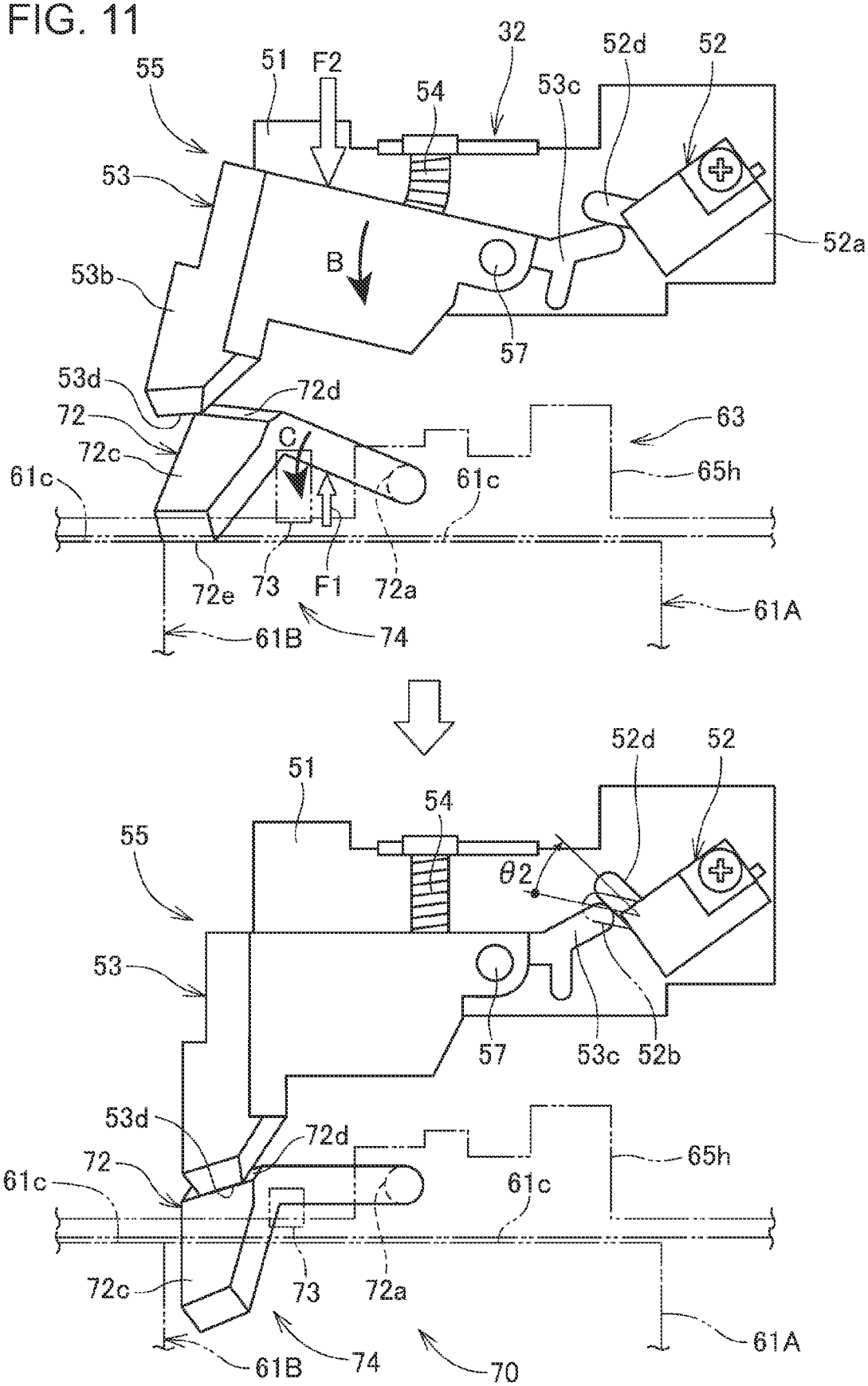
FIG. 11 is an operation diagram illustrating operations of the remaining amount detection mechanism and a detection assistance mechanism.

FIG. 11 is an operation diagram illustrating operations of the remaining amount detecting section 32 and the detection assistance section 63.

In the second roll paper 61A having an outer diameter of a predetermined value or larger than the predetermined value, the tip end 72*e* of the second protrusion 72*c* of the second detection lever 72 of the detection assistance section 63 contacts the side surface 61*a* of the second roll paper 61A.

In this state, the tip end 53*d* of the first protrusion 53*b* of the first detection lever 53 contacts the back surface 72*d* of the second protrusion 72*c*. At this time, the arm portion 53*c* of the first detection lever 53 contacts the detector 52*b* of the detection switch 52. In this state, the detection switch 52 is OFF.

When the outer diameter of the second roll paper 61A gradually becomes smaller From this state and becomes the second roll paper 61B of which the outer diameter is smaller than a predetermined value, the tip end 72*e* of the second detection lever 72 does not contact the side surface 31*a* of the second roll paper 61B. Thereby, the first detection lever 53 swings in the direction of arrow B by the first compression coil spring 54, which has an urging direction opposite to the urging direction of the second compression coil spring 73 and has a larger urging force F2 than the urging force F1 of the second compression coil spring 73. Further, the second detection lever 72 is pushed by the first protrusion 53*b* of the first detection lever 53 and swings in the direction of the arrow C.

As a result, as shown by the white arrow, the second protrusion 72*c* of the second detection lever 72 is in a state of projecting into the roll paper accommodating space 70. At this time, as the arm portion 53*c* of the first detection lever 53 further swings, the detector 52*b* of the detection switch 52 swings clockwise by an angle θ2 from the state before the swing of the first detection lever 53. As a result, the detection switch 52 is turned from OFF to ON, and this on signal is input to the controller 38. The controller 38 controls the display 39 to display the fact that the remaining amount of the second roll paper 61B is low, based on the on signal from the detection switch 52.

In this way, the position where the second protrusion 72*c* of the second detection lever 72 projects from the side wall 65*a* to the inside of the roll paper holder 22, that is, to the roll paper accommodating space 70 is defined as a third position.

Further, the position where a projecting amount of the second protrusion 72*c* of the second detection lever 72 from the side wall 65*a* into the roll paper accommodating space 70 is less than that at the third position or the second protrusion 72*c* does not project is defined as a fourth position. As described above, the second protrusion 72*c* of the second detection lever 72 can move between the third position and the fourth position.

Figure 12:
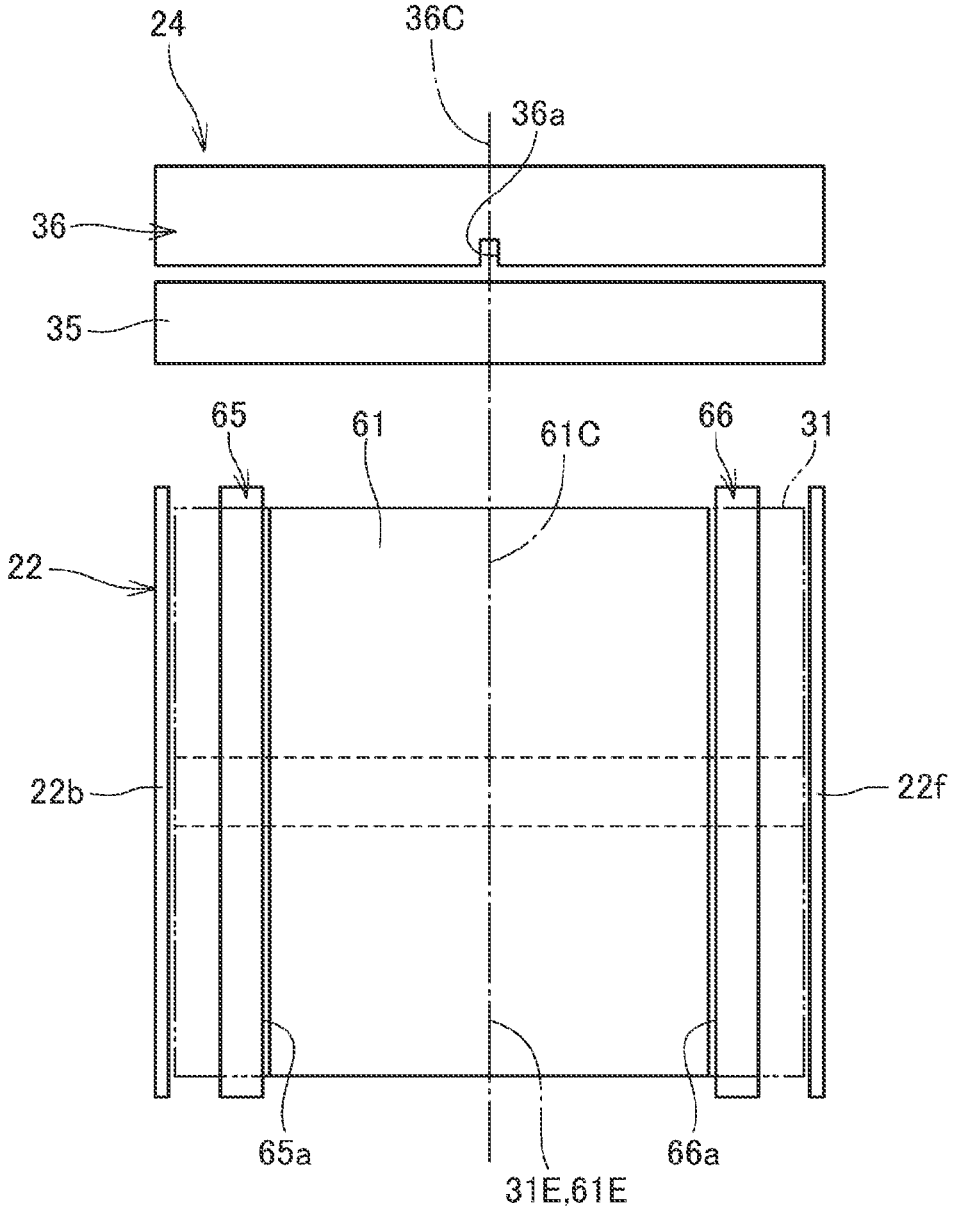
FIG. 12 is a front view showing a positional relationship between a first roll paper and a second roll paper and a cutter unit.

FIG. 12 is a front view showing the positional relationship between the first roll paper 31 and the second roll paper 61 and the cutter unit 24.

When the first roll paper 31 is accommodated in the roll paper holder 22, the first roll paper 31 is held and positioned by the side walls 22*b* and 22*f* from both sides. A first roll paper center line 31E passing through the center of the first roll paper 31 in the paper width direction coincides with a notch center line 36C passing through the center of a notch 36*a* in a blade width direction, where the notch 36*a* is formed in the center of the movable blade 36 in the width direction.

When the right and left roll paper guides 66 and 65 are mounted on the roll paper holder 22, the second roll paper 61 is held and positioned on the side wall 65*a* of the roll paper guide 65 and the side wall 66*a* of the roll paper guide 66. A second roll paper center line 61E passing through the center of the second roll paper 61 in the paper width direction coincides with the notch center line 36C.

Therefore, the thermal paper 12 drawn from the first roll paper 31 or the second roll paper 61 can be partially cut by leaving the center of the paper width.

As shown in FIGS. 4, 5, 9, and 11, the printing device 10 includes the roll paper holder 22, the remaining amount detecting section 32, the roll paper guide 65, and the detection assistance section 63.

The roll paper holder 22 can accommodate the first roll paper 31 and the second roll paper 61 having a width smaller than that of the first roll paper 31, and has the side wall 22*b* and the side wall 22*f* that can contact the side surface 31*a* of the first roll paper 31. The remaining amount detecting section 32 has the first projection 55 projecting from the side wall 22*b*, and detects the remaining amount of the first roll paper 31 accommodated in the roll paper holder 22. The roll paper guide 6 can be installed in the roll paper holder 22, and has the side wall 65*a* that can contact the side surface 61*a* of the second roll paper 61 when the second roll paper 61 is accommodated in the roll paper holder 22. The detection assistance section 63 is provided on the roll paper guide 65, and has the second projection 74 that projects from the side wall 65*a* in a state of contacting with the first projection 55.

With the configuration, the detection assistance section 63 is provided on the roll paper guide 65, and thus the remaining amount detecting section 32 and the detection assistance section 63 can detect the remaining amount of the second roll paper 61 even when the roll paper guide 65, which is the partition portion, is installed on the roll paper holder 22.

Further, as shown in FIG. 5, the printing device 10 includes the roll paper guide 65 having the side wall 65*a*, the roll paper guide 66 having the side wall 66*a* that can contact the side surface 61*a* of the second roll paper 61. One roll paper guide 65 is provided close to the side wall 22*b* of the roll paper holder 22, and the other roll paper guide 66 is provided close to the side wall 22*f* of the roll paper holder 22.

With the configuration, the second roll paper 61 can be held by the side wall 65*a* and the side wall 66*a*.

Further, as shown in FIG. 3, the first projection 55 can move between the first position where the first projection 55 projects from the side wall 22*b* to the roll paper holder 22 and the second position where the projecting amount of the first projection 55 from the side wall 22*b* to the roll paper holder 22 is less than that at the first position or where the first projection 55 does not project from the first side wall 22*b*. When the diameter of the first roll paper 31 is larger than the predetermined diameter, the first projection 55 comes into contact with the side surface 31*a* of the first roll paper 31 and is located at the second position, and when the diameter of the first roll paper 31 is smaller than the predetermined diameter, the first projection 55 projects to the first position without contacting the side surface 31*a* of the first roll paper 31.

With the configuration, it is possible to detect the state in which the remaining amount of the first roll paper 31 is low when the first projection 55 changes from the state in which the first projection 55 is in contact with the side surface 31*a* of the first roll paper 31 to the state in which the first projection 55 projects to the roll paper holder 22 by the diameter of the first roll paper 31 being smaller than a predetermined diameter.

Further, as shown in FIGS. 5, 9, and 11, the second projection 74 can move between the third position and the fourth position to be shown below. The third position is a position where the second projection 74 projects from the side wall 65*a* toward the central portion of the roll paper holder 22. The fourth position is a position where the projecting amount of the second projection 74 from the side wall 65*a* to the roll paper holder 22 is less than that at the third position or the second projection 74 does not project.

With the configuration, it is possible to detect the state in which the remaining amount of the second roll paper 61 is low when the second projection 74 changes from the state in which the second projection 74 is in contact with the side surface 61*a* of the second roll paper 61 to the state in which the second projection 74 projects into the roll paper holder 22 by the diameter of the second roll paper 61 being smaller than a predetermined diameter.

Further, as shown in FIGS. 3, 5, 9, and 11, the first projection 55 is provided to be movable or swingable with respect to the side wall 22*b*. The first projection 55 includes the first detection lever 53 that has the first protrusion 53*b*, and the first compression coil spring 54 that urges the first protrusion 53*b* in a direction of projecting to the roll paper holder 22. The second projection 74 is provided to be movable or swingable with respect to the side wall 65*a*. The second projection 74 includes the second detection lever 72 that has the second protrusion 72*c*, and the second compression coil spring 73 that urges the second protrusion 72*c* in the direction of moving from the side wall 65*a* to the side wall 22*b*. The first protrusion 53*b* abuts on the second detection lever 72 in a state of projecting to the roll paper holder 22, and the first compression coil spring 54 urges the second detection lever 72 in a direction against the urging force of the second compression coil spring 73.

With the configuration, the state in which the second protrusion 72*c* does not project to the roll paper holder 22 by the second compression coil spring 73 can be changed to the state in which the second protrusion 72*c* projects to the roll paper holder 22 by making the first protrusion 53*b* contact the second detection lever 72 by the first compression coil spring 54.

Further, as shown in FIG. 12, the printing device 10 has the movable blade 36 having the notch 36*a* and the fixed blade 35, and includes a cutter unit 24 that cuts the thermal paper 12 drawn from the second roll paper 61 by the movable blade 36 and the fixed blade 35. The roll paper guides 65 and 66 can be attached to and detached from the roll paper holder 22. The roll paper guides 65 and 66 restrict a position of the second roll paper 61 at a position where a center of the second roll paper 61 in a paper width direction and the notch 36*a* coincide with each other in a state of being mounted on the roll paper holder 22.

With the configuration, the center of the thermal paper 12 in the paper width direction can be prevented from being partially cut.

Further, as shown in FIGS. 1, 3, 4, and 11, the printing device 10 includes the display 39 and the controller 38.

The display 39 displays the remaining amount of the first roll paper 31 and the second roll paper 61. The controller 38 controls the display 39 to display a low remaining amount of the first roll paper 31 or the second roll paper 61 when the remaining amount detecting section 32 detects the low remaining amount of the first roll paper 31 or the second roll paper 61 based on the projecting state of the first projection 55.

With the configuration, the low remaining amount is displayed when the remaining amount detecting section 32 detects the low remaining amount of the first roll paper 31 or the second roll paper 61, and thus it is possible to prompt replacement of the first roll paper 31 or the second roll paper 61.

As shown in FIGS. 1, 4, 5, and 11, the printing device 10 includes the roll paper holder 22, the remaining amount detecting section 32, the roll paper guide 65, and the detection assistance section 63.

The roll paper holder 22 can accommodate the first roll paper 31 and the second roll paper 61 having a width smaller than that of the first roll paper 31, and has the side wall 22*b* and the side wall 22*f* that can contact the side surface 31*a* of the first roll paper 31. The remaining amount detecting section 32 detects the remaining amount of the first roll paper 31 accommodated in the roll paper holder 22. The roll paper guide 65 can be installed in the roll paper holder 22, and has the side wall 65*a* that can contact the side surface 61*a* of the second roll paper 61 when the second roll paper 61 is accommodated in the roll paper holder 22. The detection assistance section 63 is provided on the roll paper guide 65, and assists the remaining amount detecting section 32 in detecting the remaining amount of the second roll paper 61.

With the configuration, the detection assistance section 63 is provided on the roll paper guide 65, and thus the remaining amount detecting section 32 and the detection assistance section 63 can detect the remaining amount of the second roll paper 61 even when the roll paper guide 65 is installed on the roll paper holder 22.

The above-described embodiment illustrates one aspect of the present disclosure, and any modification and application can be made without departing from the spirit of the present disclosure.

For example, the remaining amount detecting section may have a structure other than that of the lever shape such as the first detection lever. For example, the remaining amount detecting section may have an optical detection mechanism. For example, the detection assistance section may have a structure other than that of the lever shape such as the second detection lever.

What is claimed is:

1. A printing device comprising:

a roll paper holder configured to accommodate a first roll paper and a second roll paper having a width smaller than that of the first roll paper and configured to have a first side wall and a second side wall configured to contact side surfaces of the first roll paper;

a remaining amount detecting section configured to have a first projection projecting from the first side wall to detect a remaining amount of the first roll paper accommodated in the roll paper holder;

a partition portion configured to be installed in the roll paper holder and configured to have a third side wall configured to contact a side surface of the second roll paper when the second roll paper is accommodated in the roll paper holder; and a detection assistance section configured to be provided in the partition portion and configured to have a second projection projecting from the third side wall in a state of being in contact with the first projection, wherein the first projection includes a first projection main body that is movably provided with respect to the first side wall and has a first protrusion, and a first urging portion that urges the first protrusion in a direction of projecting to the roll paper holder, the second projection includes a second projection main body that is movably provided with respect to the third side wall and has a second protrusion, and a second urging portion that urges the second protrusion in a direction of moving from the third side wall to the first side wall, and the first protrusion abuts on the second projection main body in a state of projecting to the roll paper holder, and urges the second projection main body with the first urging portion in a direction against an urging force of the second urging portion.

2. The printing device according to claim 1, wherein the partition portion has a first partition section having the third side wall and a second partition section having a fourth side wall configured to come into contact with the side surface of the second roll paper, and the first partition section is provided close to the first side wall of the roll paper holder, and the second partition section is provided close to the second side wall of the roll paper holder.

3. The printing device according to claim 1, wherein the first projection is movable between a first position where the first projection projects from the first side wall to the roll paper holder and a second position where a projecting amount from the first side wall to the roll paper holder is less than that at the first position or where the first projection does not project from the first side wall, is located at the second position by contacting the side surface of the first roll paper when a diameter of the first roll paper is greater than a predetermined diameter, and projects to the first position without contacting the side surface of the first roll paper when the diameter of the first roll paper is smaller than the predetermined diameter.

4. The printing device according to claim 1, wherein the second projection is movable between a third position where the second projection projects from the third side wall to the roll paper holder and a fourth position where a projecting amount from the third side wall to the roll paper holder is less than that at the third position or where the second projection does not project from the third side wall, is located at the fourth position by contacting the side surface of the second roll paper when a diameter of the second roll paper is greater than a predetermined diameter, and projects to the third position without contacting the side surface of the second roll paper when the diameter of the second roll paper is smaller than the predetermined diameter.

5. The printing device according to claim 1, further comprising a cutting mechanism that has a first blade having a notch and a second blade cutting a recording paper drawn from the second roll paper together with the first blade, wherein the partition portion is configured to be attached to and detached from the roll paper holder, and the partition portion restricts a position of the second roll paper at a position where a center of the second roll paper in a paper width direction and the notch coincide with each other in a state of being mounted on the roll paper holder.

6. The printing device according to claim 1, further comprising:

a display that displays the remaining amount; and a controller that controls the display to display a low remaining amount of the first roll paper or the second roll paper when the remaining amount detecting section detects the low remaining amount of the first roll paper or the second roll paper based on a projecting state of the first projection.

7. A printing device comprising:

a main body;

a roll paper holder configured to accommodate a first roll paper and a second roll paper having a width smaller than that of the first roll paper and configured to have a first side wall and a second side wall configured to contact side surfaces of the first roll paper, the roll paper holder is provided in the main body;

a remaining amount detecting section configured to have a first projection projecting from the first side wall to detect a remaining amount of the first roll paper accommodated in the roll paper holder, the remaining amount detecting section is provided in the main body;

a partition portion configured to be installed in the roll paper holder and configured to have a third side wall configured to contact a side surface of the second roll paper when the second roll paper is accommodated in the roll paper holder; and a detection assistance section configured to be provided in the partition portion and configured to have a second projection projecting from the third side wall in a state of being in contact with the first projection, wherein the first projection includes a first projection main body that is movably provided with respect to the first side wall and has a first protrusion, and a first urging portion that urges the first protrusion in a direction of projecting to the roll paper holder, the second projection includes a second projection main body that is movably provided with respect to the third side wall and has a second protrusion, and the first protrusion urges the second projection main body in a state of projecting to the roll paper holder, and the second protrusion configured to contact side surfaces of the second roll paper.

* * * * *